US006332748B1

(12) United States Patent
Doering et al.

(10) Patent No.: US 6,332,748 B1
(45) Date of Patent: Dec. 25, 2001

(54) ROTATING PAWL TOOL LATCH

(75) Inventors: David Arthur Doering, Knoxville; Donald Rodney Flatau, Oak Ridge, both of TN (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/436,649

(22) Filed: Nov. 9, 1999

(51) Int. Cl.[7] ..... E02F 3/00
(52) U.S. Cl. ..... 414/723; 37/468; 403/330
(58) Field of Search ..... 414/723; 37/468; 403/322.4, 321, 330, 326

(56) References Cited

U.S. PATENT DOCUMENTS

| | | | | |
|---|---|---|---|---|
| 3,672,521 | * | 6/1972 | Bauer et al. | 414/723 |
| 3,794,195 | | 2/1974 | Clevenger et al. . | |
| 3,876,091 | | 4/1975 | MacDonald . | |
| 3,907,142 | | 9/1975 | Welch . | |
| 3,985,249 | | 10/1976 | Aker et al. . | |
| 4,067,467 | | 1/1978 | Datta et al. . | |
| 4,068,959 | | 1/1978 | Pemberton | 403/15 |
| 4,085,856 | | 4/1978 | Westendorf . | |
| 4,119,225 | | 10/1978 | Macht et al. . | |
| 4,136,792 | | 1/1979 | Wilson . | |
| 4,236,861 | | 12/1980 | Grove | 414/540 |
| 4,488,850 | | 12/1984 | Wernimont | 414/723 |
| 4,545,720 | | 10/1985 | Cochran et al. | 414/723 |
| 4,824,319 | * | 4/1989 | Arnold | 414/723 |
| 4,929,143 | | 5/1990 | Dohnalik | 414/723 |
| 4,986,722 | | 1/1991 | Kaczmarczyk et al. | 414/723 |
| 5,082,065 | | 1/1992 | Fletcher | 172/273 |
| 5,141,385 | | 8/1992 | Tibbatts et al. | 414/723 |
| 5,224,816 | | 7/1993 | Kaczmarczyk et al. | 414/723 |
| 5,263,810 | | 11/1993 | Takekata et al. | 414/723 |
| 5,562,397 | * | 10/1996 | Albright | 414/723 |
| 5,590,483 | | 1/1997 | Kim | 37/468 |
| 5,634,735 | | 6/1997 | Horton et al. | 403/322 |
| 5,634,736 | | 6/1997 | Brown et al. | 403/322 |
| 5,836,734 | | 11/1998 | Doering | 414/723 |

OTHER PUBLICATIONS

Bobcat (Melroe), page from Model 753 Loader Parta Manual, p. B5, Publication date—unknown, Publishing in USA.

Copies of Photos by Deere & Co. employees, Copies of ten (10) photos of quick attach device on Bobcat (Melroe) Model 753 loader, Copies of ten (10) Photos on five (5) Pages, Publication date—1997, Published in USA.

Copy of Photo by Deere & Co. employees, Copy of one (1) photo of Gehl Quick Attach Device from Model 5635SXT, Publication date—1997, Published in USA.

* cited by examiner

*Primary Examiner*—Donald W. Underwood

(57) ABSTRACT

A latching device is provided for coupling a vehicle tool carrier with a variety of tools such as a bucket. The device serves to releasably secure the tool with the carrier once the carrier has been positioned with the tool. The latch includes a handle-actuated pawl and an over center linkage to retain the latching device in either its latched or unlatched position. A spring serves to hold the link in its over-center position. The pawl swings laterally to minimize interference with the carrier and tool structures and simplify activation by the operator from his seat.

13 Claims, 6 Drawing Sheets

ROTATING PAWL TOOL LATCH

BACKGROUND OF THE INVENTION

1. Field of the Invention

The present invention relates to attachment apparatus and more particularly to apparatus for attaching implements to a work vehicle such as a skid steer loader.

2. Description of Related Art

Working vehicles such as skid-steer loaders frequently have tool carriers supported at the ends of their lift arms. These carriers are adapted to be attached to a variety of tools, such as a bucket. To simplify and expedite the mounting and removal of various tools, the carriers are typically equipped with quick-attach devices. These devices typically include positioning structures to position one part of the carrier relative to the tool as well as a latching structure to secure the tool to the carrier. The structures used to position the carrier with respect to the tool often take the form of a pair of spaced apart mounting supports on the upper portion of the tool designed to receive a compatibly spaced apart pair of carrier wedges on the tool carriers which are configured to be received by the mounting supports. Commonly, the mounting support includes an outwardly extending lip beneath which the carrier wedges are received. Generally the supports and wedges are widely spaced on the tool and carrier to provide a stable mounting connection. To lock the tool to the carrier, movable latch pins are provided below the positioning structure, and usually on the carrier, for being received in openings provided on the tool. The latch pins are typically inserted into and removed from the tool openings by swinging movement of a handle coupled with axial movement of the pin.

One known latching device has a handle-actuated latching pin structure with a detent to retain the pin in its latched or unlatched positions to prevent inadvertent unlatching which could result in the tool and carrier coming apart during operation.

These conventional latching devices typically use a pin sliding through some type of guide to secure the tool to the carrier. After operation in dirt or mud, which is the design of these machines, this pin becomes very difficult to move so that a different attachment may be connected to the machine.

SUMMARY OF THE INVENTION

In the present invention, a latch is provided having a rotating pawl which is used to latch a tool to a carrier mounted on a working vehicle. The pawl is forgiving to debris and trash and thus provides easier and more reliable operation in dirty or otherwise contaminated conditions as compared to conventional latching devices.

In an exemplary embodiment of the present invention, a latching device is provided which includes a handle-actuated pawl which swings about a pin on a carrier frame main mounting plate. A connector link from a handle provides the rotating motion. There are two links on the mechanism which both have springs to allow for over-center travel in the linkage. One over-center spring is used to lock the pawl in the down position to insure that attachments do not come loose from the base machine. The other is used to hold the handle in the up position making it possible to change attachments with only one person. The pawl pivots laterally (about a pivot axis extending generally parallel to the major axis of the vehicle), so that the entire mechanism and thus the entire attachment weight can be held closer to the front wheels, resulting in a more stable vehicle. In the preferred embodiment, two spaced-apart latching devices are provided at spaced apart positions on the carrier to ensure a stable attachment of the tool to the carrier.

DETAILED DESCRIPTION OF EXEMPLARY EMBODIMENT

Figure 1:
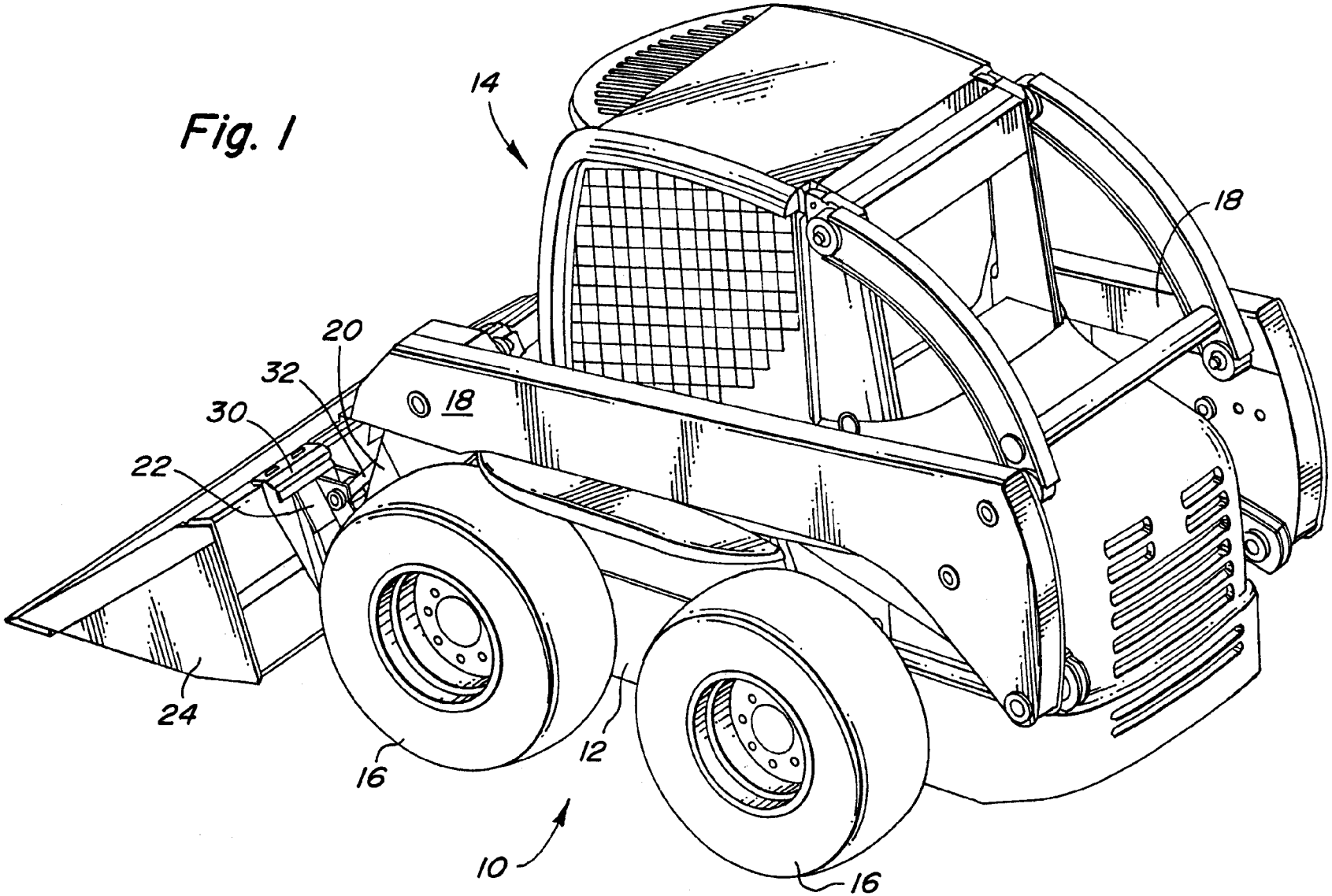
FIG. 1 is an elevated left rear perspective view illustrating the latching device according to the present invention utilized on a skid-steer loader and a bucket.

Looking first to FIG. 1, there is shown in perspective a skid-steer loader 10, including a frame 12 which supports an operator enclosure 14 and to which wheels 16 are mounted. The loader 10 includes booms 18 and lift arms 20 which are used to manipulate a work tool mounted at the front of the loader 10. The lift arms 20 terminate at their distal end at a tool carrier 22 which is adapted for being readily connected to a tool 24 such as the bucket illustrated. The carrier 22 shown in FIGS. 1–4 is adapted to carry support structures for readily connecting and disconnecting the working tool or bucket 24 from the loader 10. The support structures include laterally spaced-apart positioning structures on each of the tool 24 and carrier 22 for orienting the carrier 22 for attachment to the tool 24 and a latching device 26 for securing the tool 24 to the carrier 22.

Figure 2:
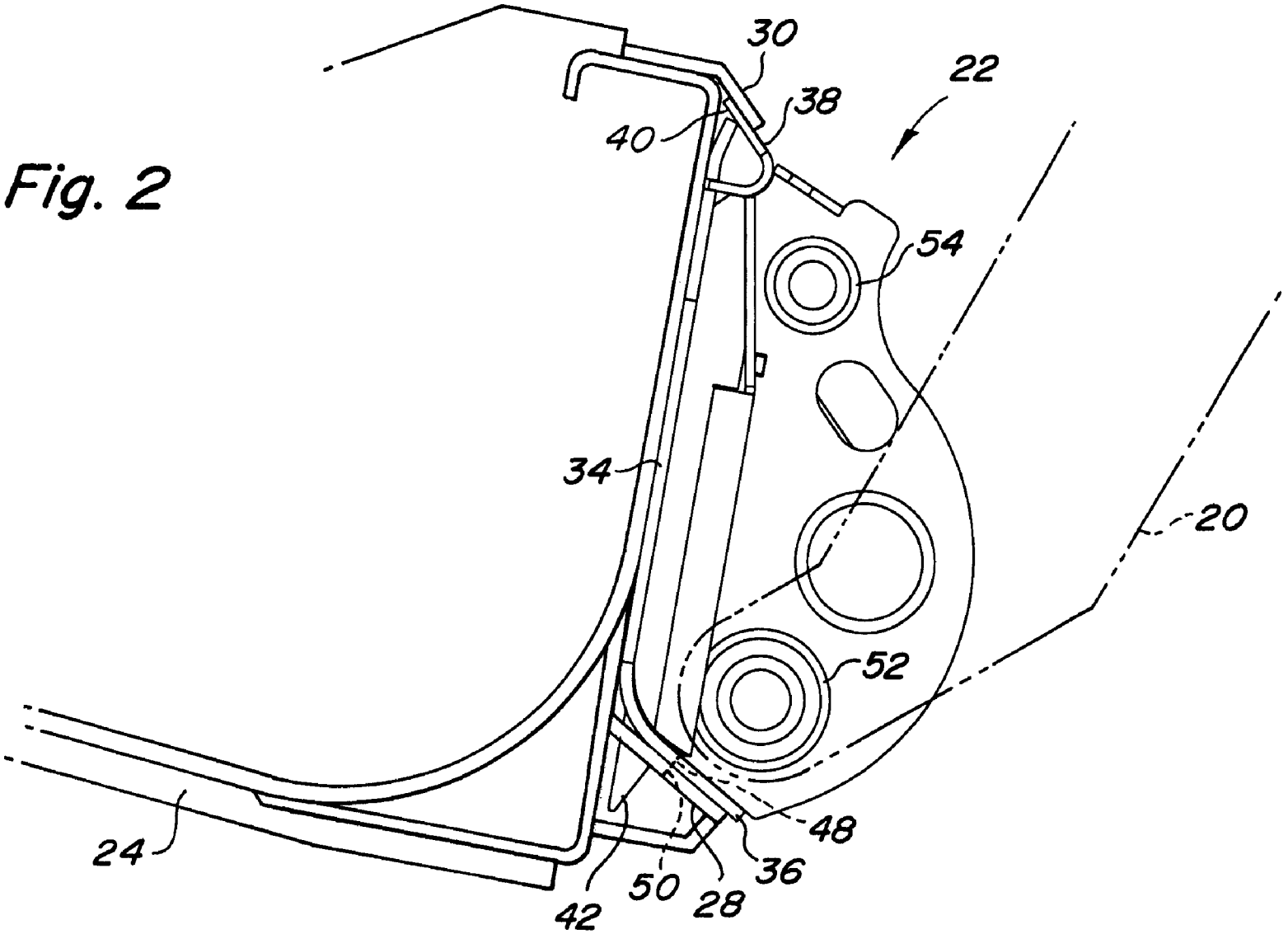
FIG. 2 is a left side elevational schematic view of the latching device in its latched position engaged with the bucket of FIG. 1.

Referring now also to FIG. 2, the positioning structures on the tool 24 include upwardly extending ramp plates 28 at the lower portion of the tool 24 and a downwardly extending upper lip 30 at the top of the tool 24. Hydraulic cylinders 32 are provided between the lift arms 20 and carrier 22 to tilt the carrier 22 and orient it with respect to the tool 24 so that an upwardly extending front plate 34 on the carrier 22 can be slidably positioned beneath the downwardly extending upper lip 30 of the tool 24. As the cylinders 32 are activated to position the front plate 34 beneath the tool's upper lip 30, a bottom ramp plate 36 of the carrier 22 will slidably move along the bottom ramp 28 of the tool 24 to guide a wedge portion 38 at the top of the carrier's front plate 34 up and into a recess 40 beneath the upper lip 30 of the tool 24.

Figure 3:
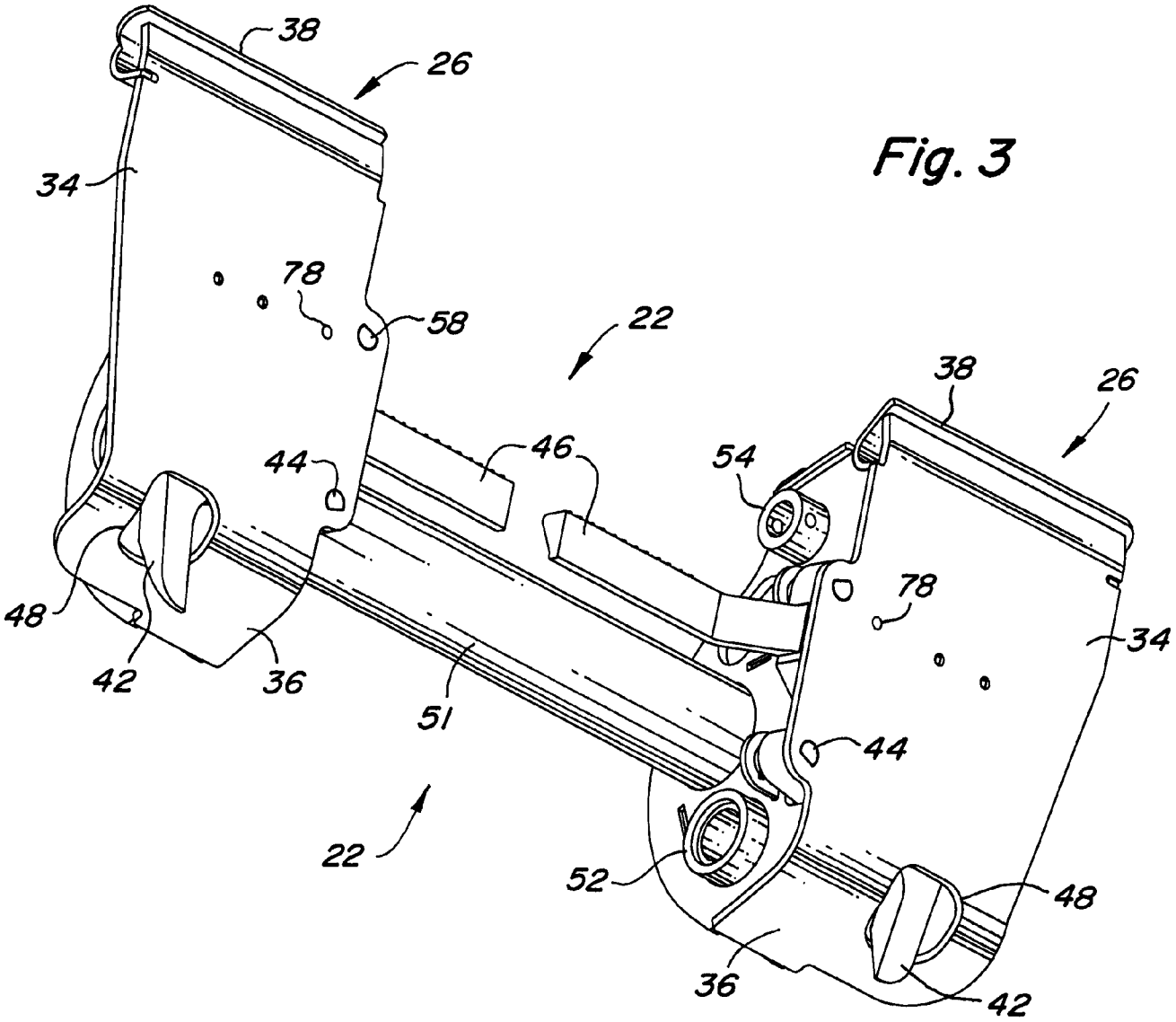
FIG. 3 is a left rear worm's eye view of a pair of the latching devices in their latched positions.

Once the carrier 22 has been positioned, it must be attached to the tool 24. For this purpose, the latching device 26 is provided on each lateral side of the carrier 22 (as shown in FIG. 3) to secure that side of the carrier 22 with its respective side of the tool 24. Each latching device 26 utilizes a pawl 42 that is secured to the carrier 22 by and supported for swinging movement on a pivot 44 extending generally parallel to the major (longitudinal) axis of the loader 10. The pawl is rotated by a latch handle 46 to insert it into or remove it from an opening 48 provided in the bottom ramp plate 36 of the carrier 22 and an aligned opening 50 in the ramp plate 28 of the tool 24 to secure the carrier 22 with the tool 24.

Figure 4:
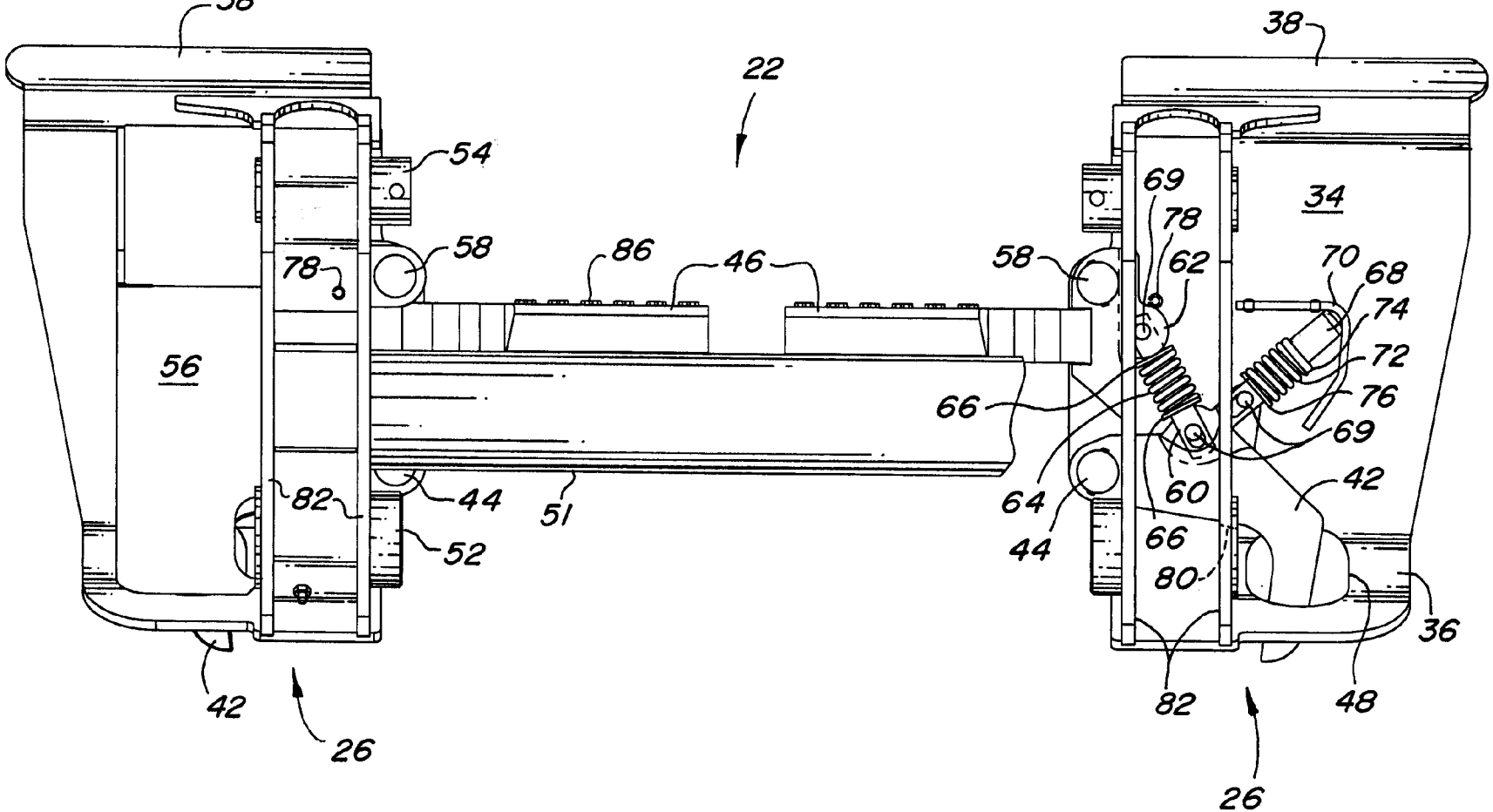
FIG. 4 is a rear elevational view of the latching devices in their unlatched position wherein the illustration of the housing surrounding the right hand latching device is fragmented to illustrate the components of the latching device.

Looking now to FIGS. 3 and 4, the carrier 22 is shown with laterally spaced latching devices 26 connected by a support member 51. The carrier is provided with inboard pivot supports 52 which serve as an attachment point of the carrier 22 to the lift arms 20 so that the carrier may pivot with respect to the lift arms. The carrier 22 is also provided with cylinder mounting brackets 54, which provide points of attachment for the hydraulic cylinders 32. The handles 46 are shown in their generally horizontal, latched positions and the pawls are shown in their corresponding latched positions wherein a tip of the pawl 42 extends through the opening 48.

The assembly connecting the pawl 42 to the handle 46 is shown in the right-hand latching device 26 of FIG. 4, wherein a rear cover plate 56 has been removed to better show the components of the latching device 26. The handle 46 is pivotally mounted to the carrier 22 on a pivot 58. A handle-pawl link 60 is pinned at one end to an outboard extension 62 of the handle 46 for relative swinging movement by a pin 69 passed through the link 60 and the extension 62 of the handle 46 and sandwiched between the front plate 34 and the rear plate 56 of the carrier 22. At its other end, the link 60 is similarly pinned to the pawl 42. Between the handle 46 and the pawl 42, the link 60 is encompassed by a spring 64 that is sandwiched between washers 66 abutting the handle 46 and the pawl 42. A second link 68 is rotatably pinned to the pawl 42 at one end, also by a pin 69 passed through the link 68 and the pawl 42 and sandwiched between the front and rear plates 34, 56 of the carrier 22. At its other end the link 68 abuts a bracket 70 welded to the faceplate 34 of the carrier 22. A spring 72 is positioned over the second link 68 and sandwiched between a collar 74 on the link and a washer 76 which abuts the pawl 42. In their respective latched positions shown in FIG. 4, the handle 46 is in an abutting relationship with a handle stop 78 in the form of a roll pin press-fit in the carrier 22, and the pawl 42 abuts a pawl down stop in the form of an end of a slot 80 provided in a carrier reinforcement gusset 82. In the exemplary embodiment, the openings in the links 60, 68 through which the pins 69 are inserted at their ends of attachment with the pawl 42 are shown as elongated slots. Although a lost motion connection is not necessary for the links 60, 68 to achieve their over-center positions, the openings are elongated to allow for tolerances and the use of pawls of varying sizes.

Figure 5:
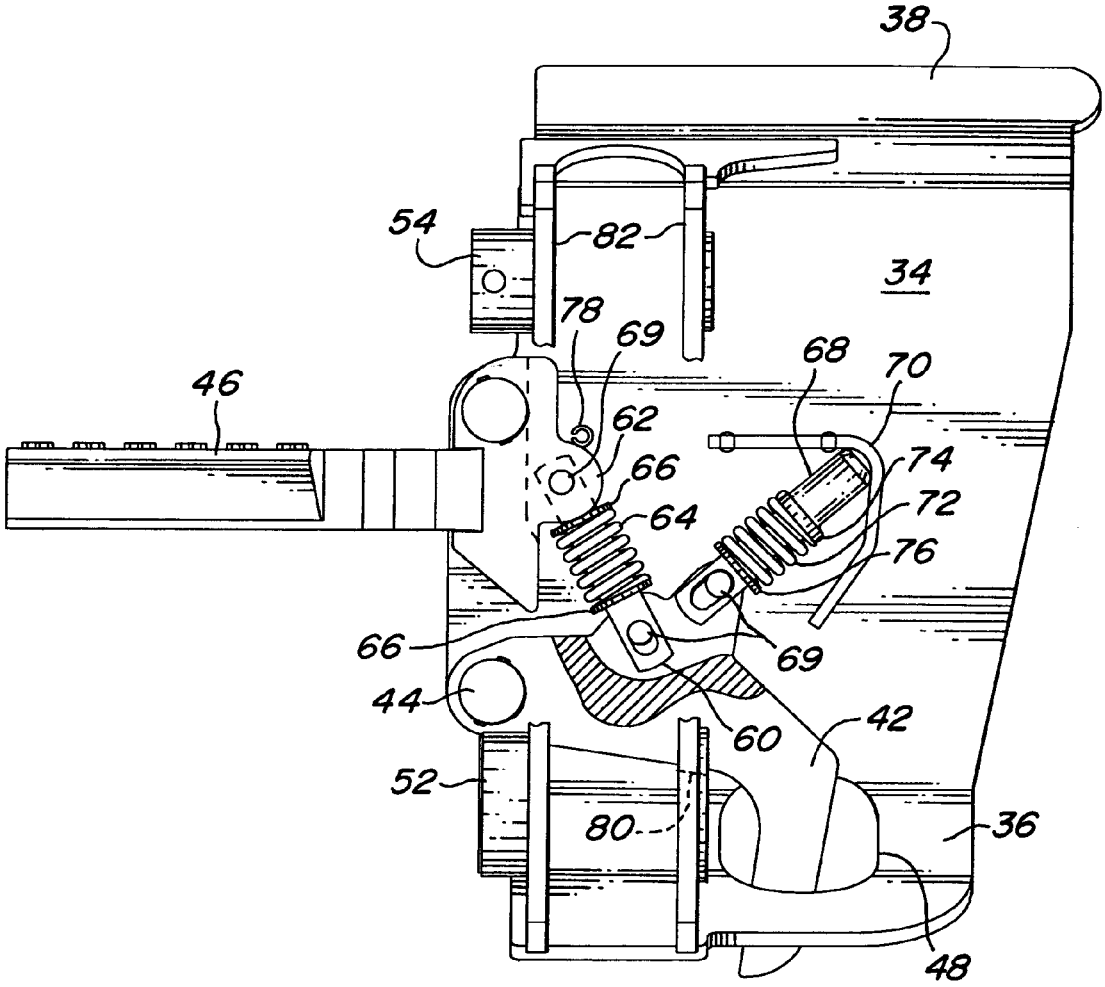
FIG. 5 is a rear elevational view of a latching device according to the present invention shown in its latched position.

Looking now to FIG. 5, the latching device 26 is shown in its latched position and the links 60, 68 are shown in their latched over-center positions. In the latched over-center position of the link 68, an end of the link 68 is trapped in a corner of the bracket 70 and the spring 72 biases the pawl 42 toward its latched position, wherein the pawl 42 engages its down stop 80 and the tip of the pawl 42 extends through the opening 48 and will also extend through the opening 50 in the bottom ramp surface 28 of the tool 24 to secure the carrier 22 with the tool 24 (see FIGS. 1 and 2). The link 60 is also in its latched over-center position wherein its associated spring 64 serves to bias the handle 46 away from the pawl 42 and hold the handle 46 is its latched position, as illustrated in FIGS. 2–5. The pin 78 serves as a down stop to ensure that the handle 46 achieves a secure, generally horizontal orientation in its latched position. The latched over-center positions of the links 60, 68 shown assist in assuring that the latch device 26 will remain in its latched position without the necessity of a constant application of force.

Figure 6:
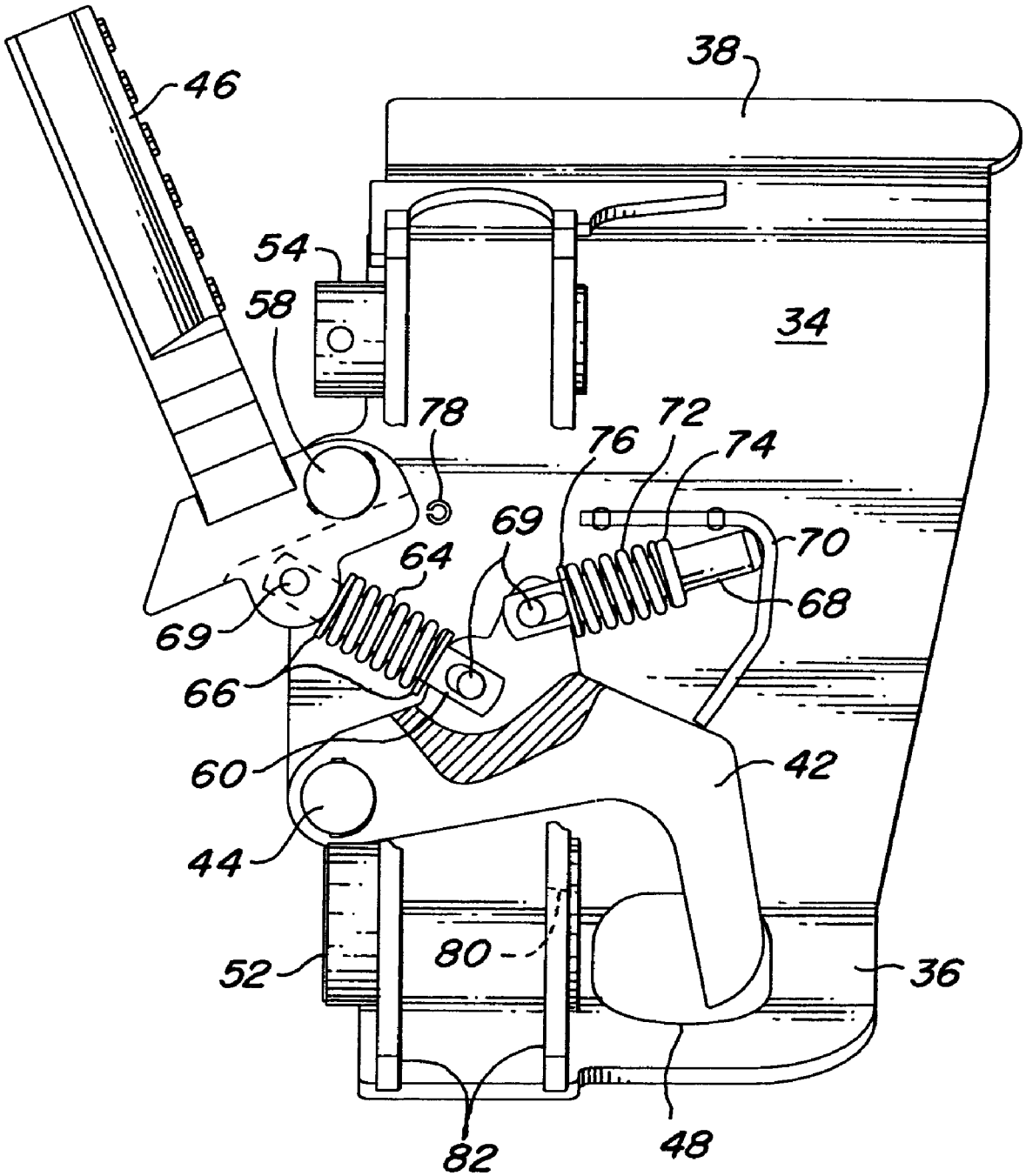
FIG. 6 is a rear elevational view of a latching device according to the present invention shown in its unlatched position

Referring now to FIG. 6, the latching device 26 is shown in its unlatched position and the links 60, 68 are shown in their unlatched over-center positions. In the unlatched over-center position of the link 68, an end of the link 68 is trapped in a corner of the bracket 70 and the spring 72 biases the pawl 42 toward its unlatched position, wherein the pawl 42 engages an edge of the bracket 70 which serves as an up stop and the tip of the pawl 42 is withdrawn from the opening 48. The link 60 is also in its unlatched over-center position wherein its associated spring 64 serves to bias the handle 46 away from the pawl 42 and hold the handle 46 is its unlatched position. The unlatched over-center positions of the links 60, 68 retain the latching device 26 in its unlatched position which allows a single operator to properly position the carrier 22 with respect to the tool 24, the tip of the pawl 42 being retained from opening 48 and preventing interference so that manipulation of the handles 46 required only to place the latching device 26 in its latched position after the tool 24 and carrier 22 have been positioned.

Looking back to and comparing FIGS. 5 and 6, it can be seen that when the operator wants to move the latching device 26 from the latched position illustrated in FIG. 5 to the unlatched configuration illustrated in FIG. 6, he or she moves the handle 46 clockwise to its raised, unlatched position to lift the pawl 42 out of the opening 50 and rotate the pawl 42 counterclockwise as viewed in FIG. 6 (the handles 46 shown are provided with raised surfaces 86 intended to provide a better frictional grip). The pawl swings laterally to minimize interference with the carrier and tool structures and simplify activation by the operator from his seat. During this movement the link 68 will move from the latched overcenter position illustrated in FIG. 5 biasing the pawl 42 against its down stop 80 to the unlatched over-center position illustrated in FIG. 6 biasing the pawl 42 against its up stop (bracket 70). Further, the link 60 will also move from a latched over-center position biasing the handle 46 toward its full-counterclockwise, latched position, abutting the pin 78(shown in FIG. 5) to an unlatched over-center position wherein the handle 46 has rotated clockwise to its unlatched position corresponding to the position of the pawl 42 when the pawl 42 contacts the bracket 70. When rotation of the handle 46 is completed, the respective springs 64, 72 on both links 60, 68 bias the pawl 42 and handle to their unlatched positions and the pawl 42 and handle 46 will be retained in their unlatched orientation until force is applied to the handle to overcome the biasing force of the springs 64, 72.

Thus, a rotating pawl tool latch is provided. One skilled in the art will appreciate that the present invention can be practiced by other than the described embodiments, which are presented for purposes of illustration and not limitation, and the present invention is limited only be the claims that follow.

What is claimed is:

1. A vehicle carrier frame having a latch for releasably securing the frame to a tool having an opening therein, said latch including:

a pivot support carried by the carrier frame, said pivot support extending generally parallel to a major axis of the vehicle;

a pawl having a tip portion, said pawl supported by the pivot support for swinging movement between a first position where the tip portion is adapted to project into the opening of the tool and a second position where the tip portion is adapted to be removed from said opening;

an actuator coupled to the pawl and engageable by an operator for moving the pawl between its first and second positions, said actuator also being moveable between first and second positions as the pawl is moved between its first and second positions; and an over-center linkage operatively coupling the pawl to the actuator and to the frame, respectively, to releasably secure the actuator and the pawl in their respective first and second positions.

2. The latch of claim 1 wherein the actuator is a handle, said handle pivotally coupled to the carrier frame and swingable between its first and second positions.

3. The latch of claim 1 wherein the handle is adapted to swing through an angle of less than 90 degrees as it is moved between its first and second positions.

4. The latch of claim 2 wherein the handle extends laterally inboard from the pawl.

5. A vehicle carrier frame having a latch for releasably securing the frame to a tool having an opening therein, said latch comprising:

a first pivot support carried by the frame;

a latch handle supported by the first pivot support for swinging movement between a first and a second position;

a second pivot support carried by the frame;

a pawl having a tip portion, said pawl supported by the second pivot support for swinging movement between a first position where the tip portion is adapted to project into the opening of the tool and a second position where the tip portion is adapted to be removed from said opening; and an over-center linkage operatively coupling the pawl to the handle and to the frame, respectively, to releasably secure the handle and the pawl it their respective first and second positions, said handle operatively coupled to the pawl so that the tip portion is moved between its first and second positions as the handle is respectively moved between its first and second positions.

6. The latch of claim 5 wherein the pawl pivots about an axis extending generally parallel to the longitudinal axis of the vehicle.

7. The invention defined in claim 5 wherein the handle is adapted to swing through an angle of less than 90 degrees as it is moved between its first and second positions.

8. The latch of claim 5 wherein the carrier supports a plurality of latches thereon.

9. The latch of claim 8 wherein the handle on each of the plurality of latches extends laterally.

10. A vehicle carrier frame having a latch for releasably securing the frame to a tool having an opening therein, said latch comprising:

a first pivot support carried by the frame;

a latch handle supported by the first pivot support for swinging movement between a first and a second position;

a second pivot support carried by the frame, said second pivot support extending generally parallel to a major axis of the vehicle;

a pawl having a tip portion, said pawl supported by the second pivot support for swinging movement between a first position where the tip portion is adapted to project into the opening of the tool and a second position where the tip portion is adapted to be removed from said opening;

a first over-center linkage operatively connecting the pawl and the carrier for biasing the pawl toward its second position;

a second over-center linkage operatively connecting the handle and the pawl for retaining the handle in at least one of its first and second positions when the pawl is in a corresponding one of its first and second positions; and said handle operatively coupled to the pawl so that the tip portion is moved between its first and second positions as the handle is respectively moved between its first and second positions.

11. The latch of claim 10 wherein the first pivot support extends generally parallel to the longitudinal axis of the vehicle.

12. The latch of claim 10 wherein the handle is adapted to swing through an angle of less than 90 degrees as it is moved between its first and second positions.

13. The latch of claim 10 wherein the handle extends laterally inboard from the pawl.

* * * * *